US005303727A

United States Patent [19]

Wilson et al.

[11] Patent Number: 5,303,727

[45] Date of Patent: Apr. 19, 1994

[54] FLUIDIC DEFLECTOR JET SERVOVALVE

[75] Inventors: Samuel L. Wilson, Newhall; Mario A. Rodriguez, Oxnard, both of Calif.

[73] Assignee: HR Textron Inc., Valencia, Calif.

[21] Appl. No.: 993,264

[22] Filed: Dec. 18, 1992

[51] Int. Cl.[5] ..... F15B 13/043; F15B 13/044

[52] U.S. Cl. ..... 137/83; 137/625.63

[58] Field of Search ..... 137/83, 625.63, 831, 137/833

[56] References Cited

U.S. PATENT DOCUMENTS 3,285,265 11/1966 Boothe et al. ..... 137/833 X
3,543,051 11/1970 McFadden et al. .
3,612,103 10/1971 Waddington ..... 137/83 X
3,680,576 8/1972 Kiwak ..... 137/833

*Primary Examiner*—Gerald A. Michalsky
*Attorney, Agent, or Firm*—Robbins, Berliner & Carson

[57] ABSTRACT

A deflector jet servovalve including a fluidic amplifier constructed utilizing a plurality of laminae stacked one upon the other and bonded together to form an integral laminated structure. The fluidic amplifier includes a fixed ejector and a pair of receivers disposed opposed the ejector with a movable deflector disposed between the ejector and the receivers to deflect a jet stream emanating from the ejector. Conduit means is also defined in the integral laminated structure to supply fluid under pressure to the ejector and to receive any differential fluid output therefrom.

7 Claims, 4 Drawing Sheets

FLUIDIC DEFLECTOR JET SERVOVALVE

BACKGROUND OF THE INVENTION

This invention relates generally to the art of servovalves and more particularly to servovalves of the fluidic deflector jet type.

Electrohydraulic servovalves may be single stage or two-stage devices. A first stage of such valves has assumed a variety of forms including sliding spools, jet pipes, flappers and nozzles as well as a deflector jet. The present invention is directed to the deflector jet type of valve as disclosed in U.S. Pat. No. 3,542,051. This invention is an improvement over the first stage of the servovalve as disclosed in U.S. Pat. No. 3,542,051 and therefore the disclosure contained in that patent is incorporated herein by this reference.

SUMMARY OF THE INVENTION

A deflector jet servovalve including a plurality of lamina stacked one upon the other and bonded together to form an integral laminated structure. The integral laminated structure defines a fixed ejector and a pair of receivers disposed opposed thereto with a moveable deflector disposed between the ejector and the receivers to deflect a jet stream emanating from the ejector. Conduit means is defined by the integral laminated structure to supply fluid under pressure to the ejector and to receive any differential fluid output from the receivers. The moveable deflector is coupled to an electrically activated motor means for moving the deflector responsive to electrical signals applied to the motor.

DETAILED DESCRIPTION

As above pointed out, the present invention is an improvement over the deflector jet servovalve as disclosed in U.S. Pat. No. 3,542,051 which has been incorporated herein by reference. As is shown in U.S. Pat. No. 3,542,051, a deflector movably responsive to a control signal is arranged in a servovalve to deflect a free jet stream of fluid discharged from a fixed nozzle with respect to a pair of fixed receiver passages. Such deflection produces a differential fluid output in the fixed receiver passages which is responsive to the control signal. The fixed relation between the ejector nozzle and the receiver passages is accurately provided by forming wall surfaces in a single member covered on opposite sides by end members, one of which has formed therein conduits through which fluid flows. The conduits interconnect with the nozzle and with the receiver passages. The single member covered by the end members, as a combination, is press-fitted into a recess in the body of the servovalve to eliminate the need for special sealing means where the fluid is transferred between the valve body and the end member. The discharge orifice of the ejector nozzle and the entrance ports to the receiver passages are rectangular and thus provide linearity of response sensitivity. The entrance ports to the receiver passages are separated only by an apex ridge which is disposed centrally opposite the discharge orifice.

Figure 1:
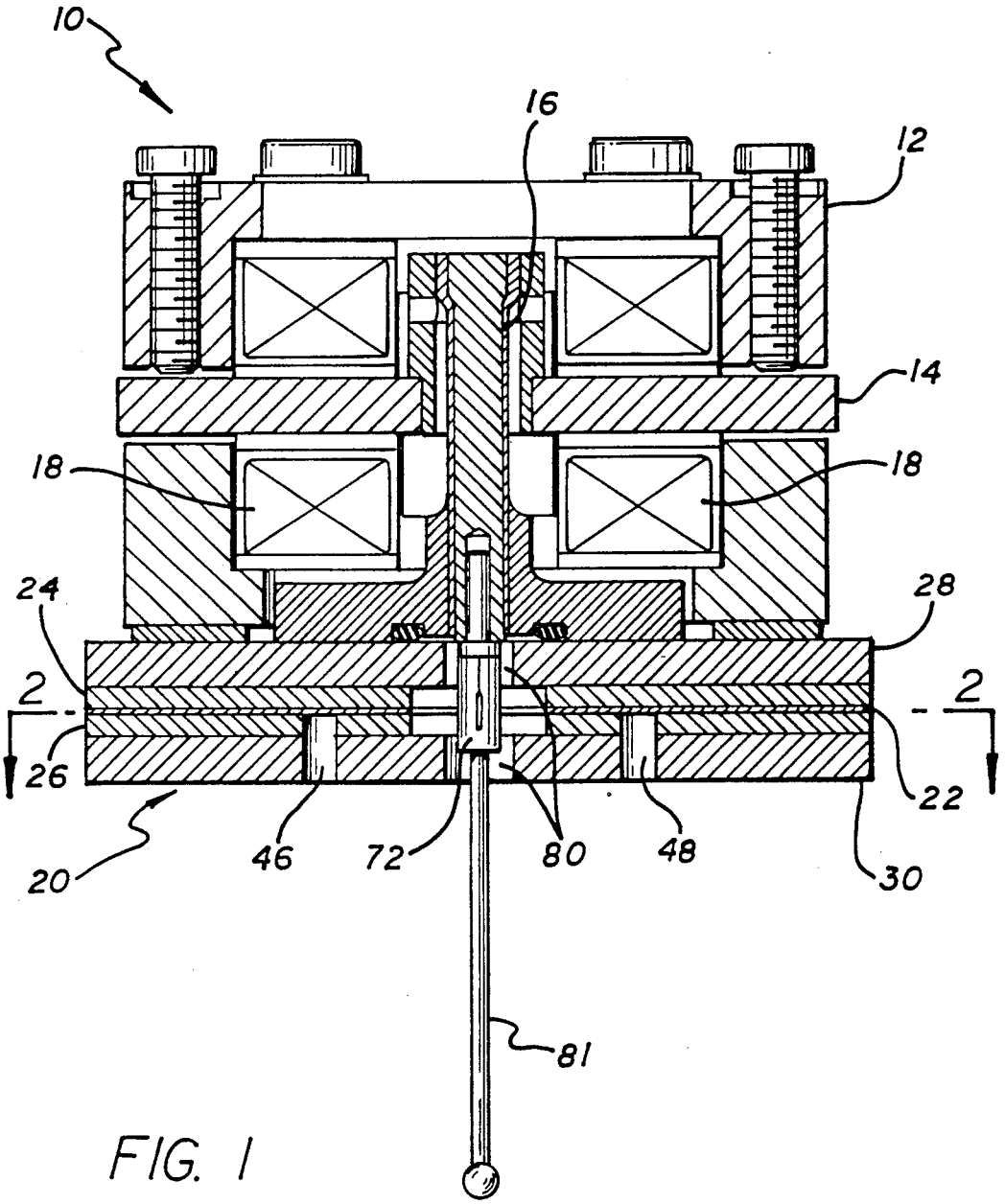
FIG. 1 is a cross-sectional view of the first stage of a servovalve constructed in accordance with the principles of the present invention.
Figure 2:
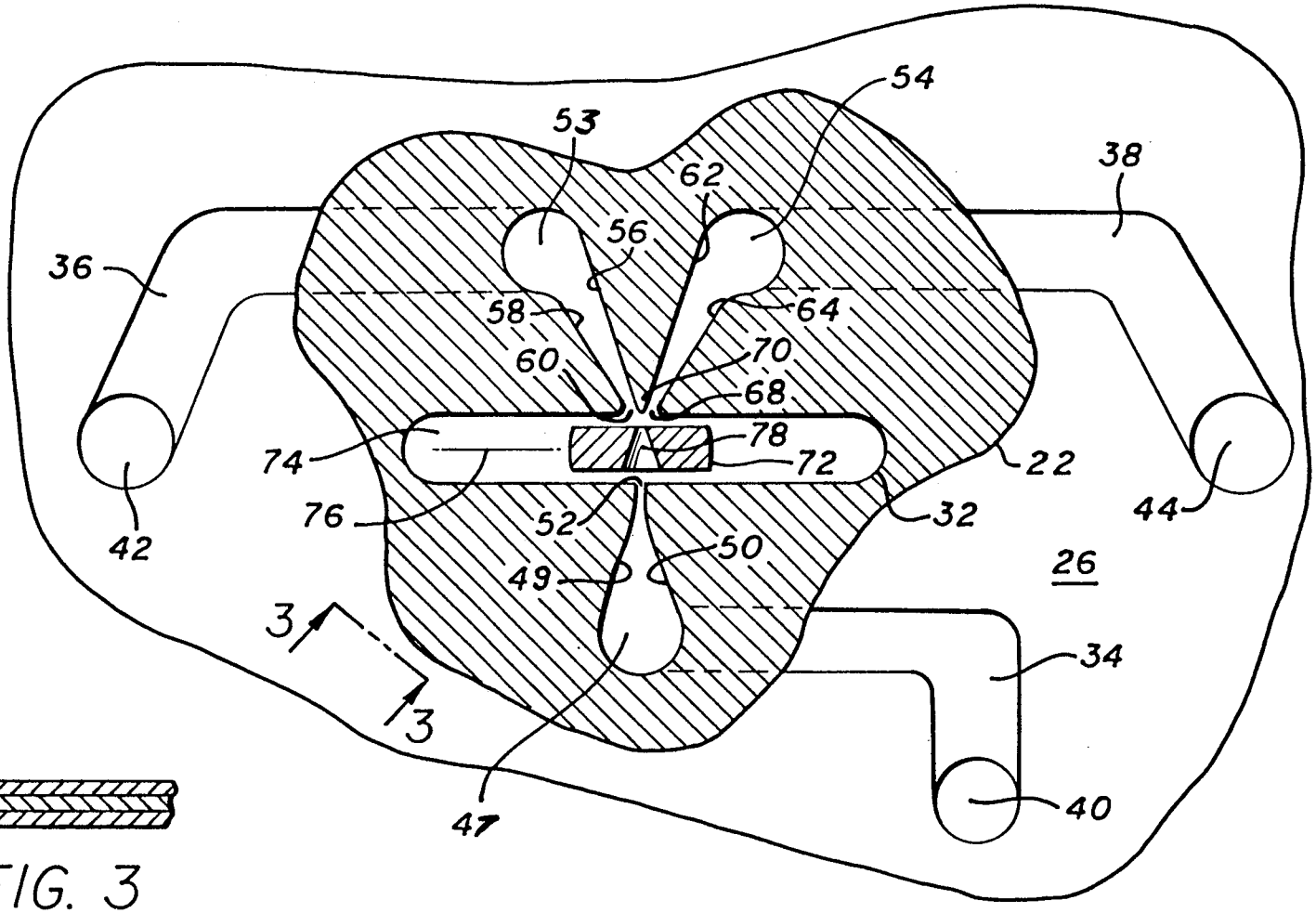
FIG. 2 is a fragmentary partial cross-sectional view of a portion of the structure FIG. 1 taken about the lines 2—2.
Figure 3:
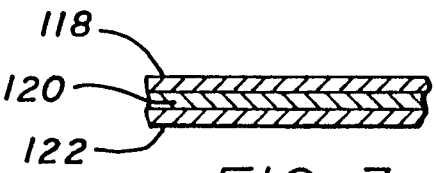
FIG. 3 is a partial cross-sectional view taken at the lines 3—3 of FIG. 2.

As shown in FIGS. 1 through 3 hereof, the jet deflector servovalve of the present invention includes a first stage 10 having a torque motor 12. As is well known in the prior art, the torque motor 12 includes an armature 14 which is supported upon a flexure tube 16. The armature 14 moves in response to electrical signals from a source (not shown) applied to coils 18. Appropriate permanent magnets and adjustment devices are provided as is well known in the prior art.

In accordance with one feature of the present invention, the nozzle and receiver passages and interconnecting conduits are provided by a plurality of laminae 20 which are bonded together at their interfaces. The plurality of laminae 20 include a central lamina 22 having intermediate laminae 24 and 26 disposed on opposite sides thereof. End or outer laminae 28 and 30 are disposed on the outer surfaces of the laminae 24 and 26 respectively. As above indicated, during the manufacturing process, this plurality of laminae 22 through 30 are stacked one upon the other after being properly cleaned. They are then subjected to pressure on the order of approximately 500 pounds per square inch and are then raised to a temperature on the order of 2,000° F. in an inert atmosphere and held there for a period of 5–10 minutes. As a result, the plurality of laminae 22 through 30 are diffusion bonded together to form an integral laminated structure 20 which houses the fluidic component defining the nozzle and receiver passages and the conduits appropriately connected thereto. Alternatively the laminae may be brazed to bond them together and if desired may be plated with a layer of copper prior to brazing or diffusion bonding. It is believed that the copper, in the diffusion bonding process, merely fills minor imperfections (if any) which may exist in the surfaces of the laminae. Such diffusion bonding eliminates cross leakage of fluid between the receivers and leakage between the laminae, therefore pressure end flow recovery is enhanced.

Prior to the stacking and bonding, the inner or central lamina 22 has formed therethrough an opening represented generally at 32 (FIG. 2) of the well known fluidic amplifier configuration. The intermediate lamina 26 has formed therethrough passageways as shown at 34, 36 and 38. The passageway 34 terminates in an opening 40 while the passageways 36 and 38 terminate in openings 42 and 44, respectively. The outer lamina 30 has formed therethrough openings 46 and 48 which when finally assembled coincide with the openings 42 and 44 provided in the intermediate lamina 26. The openings 46 and 48 provide ports from the first stage 10 to provide the flow of fluid under pressure from the first stage to an appropriate using device, one form of which will be discussed further hereinbelow. Also provided in the lamina 30 is an additional opening (not shown) which coincides with the opening 40. This opening interconnects with a source of fluid under pressure (not shown) to provide a jet stream of fluid for use in the fluidic amplifier 32. The through opening 32 provides a slot or compartment 47 having a pair of converging side walls 49 and 50 which define a nozzle or ejector 52 from which fluid under pressure from the source connected to the opening 40 emanates. The through opening 32 also provides additional elongated slots or compartments 53 and 54. The compartment 53 defines a pair of converging sidewalls 56 and 58 which terminate in a receiver 60. The compartment 54 defines a pair of converging sidewalls 62 and 64 which define a receiver 68. The receiver 60 and 68 openings are separated by an apex or vertical ridge 70 which is disposed directly opposite the ejector nozzle 52. Thus with nothing further, fluid emanating from the ejector 52 strikes the apex 70 and divides equally and enters the receivers 60 and 68 in equal amount with no differential therebetween. The flow through the passageways 36 and 38 and out the openings 46 and 48 would under those circumstances be equal.

A deflector member 72 is disposed within the slot 74 formed in the through opening 32 and moves transversely of the ejector and receivers along the line 76 in response to movement of the armature 14. An opening 78 is provided through the deflector 72. As the deflector 72 moves to the left or right as viewed in FIG. 2, responsive to signals applied to the torque motor 12, fluid emanating from the ejector 52 is caused to deflect thus causing a differential pressure flow into receivers 60 and 68 and out the openings 46 and 48 (FIG. 1).

Each of the lamina is also provided with a central opening as is illustrated at 80 through which the deflector extends and which also serves as the return for the fluidic amplifier. If the first stage 10 is to be interconnected to a second stage as is illustrated in FIGS. 3 and 4, an appropriate feedback spring 81 may be connected thereto as is illustrated in FIG. 1.

Figure 4:
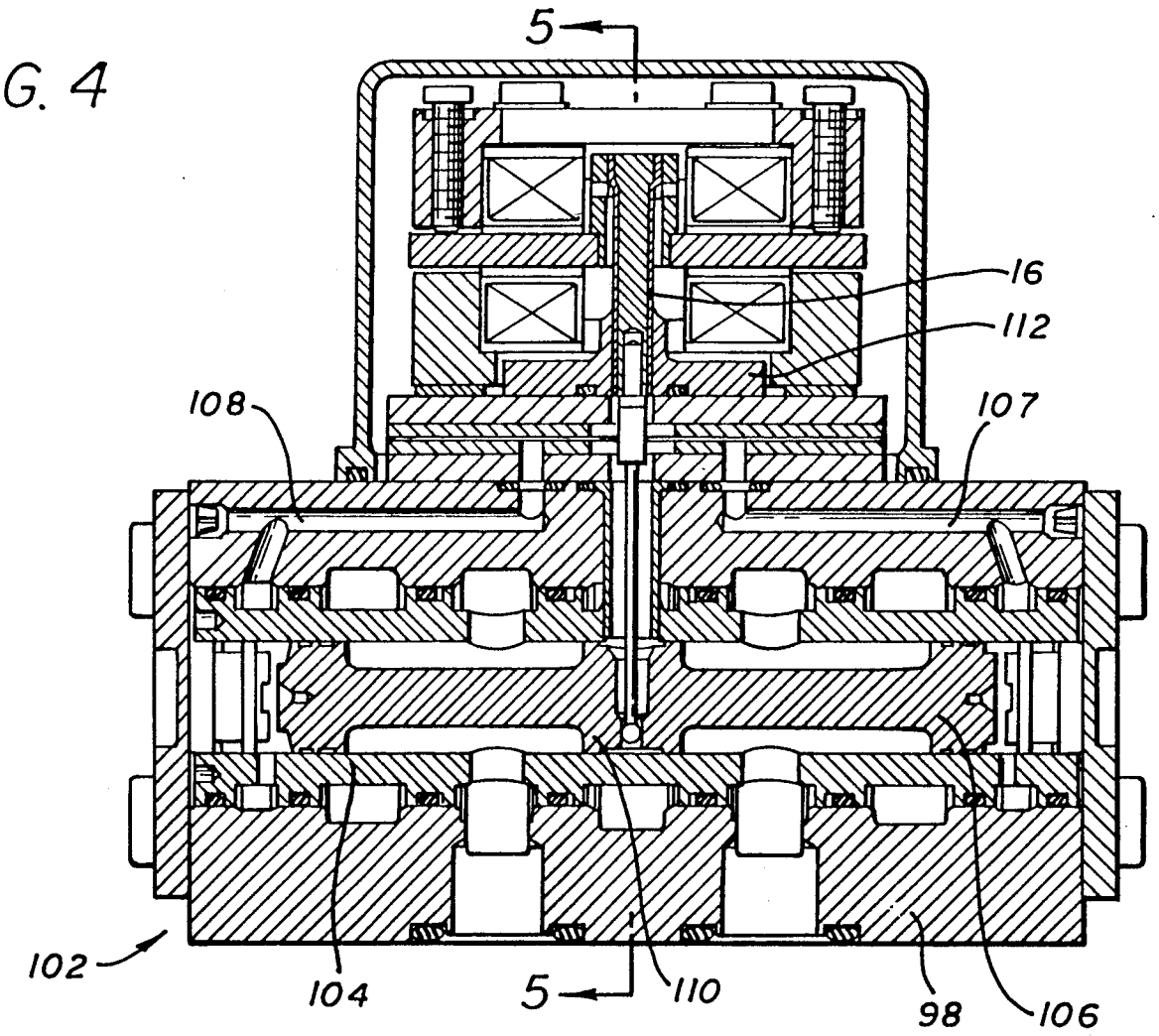
FIG. 4 is a cross-sectional view of a two-stage servovalve constructed in accordance with the principles of the present invention.

An additional feature of the present invention is that the bonded integral laminated structure 20 is utilized as the base to which the armature assembly is attached as is illustrated in FIG. 4 to which reference is hereby made and also is utilized as the structure for attaching the first stage to the second stage housing as is also shown in FIG. 4.

As a result of the diffusion bonding process, above referred to, the integral laminated assembly 20 is annealed and therefore can be easily drilled and tapped. Therefore, at the conclusion of bonding, the threaded openings as illustrated at 82–88, are provided to receive fastening devices 90–96, respectively. Obviously, additional fastening devices may also be utilized if desired at other positions to properly secure the integral laminated structure 20 to the housing 98 or the armature assembly 100 to the integral laminated structure 20 as may be required. Thereafter, appropriate heat treatment is applied to harden the laminated assembly for erosion control.

Referring now more particularly to FIG. 4, the second stage 102 for the valve is illustrated and includes a housing 98 within which is disposed a sleeve 104 and a spool 106 as is well known. The openings 46 and 48 in the outer lamina 30 function as ports to provide the differential flow through conduits 107 and 108 to the outer ends of the spool 106 to cause it to reciprocate within the sleeve 104 as is well known. The feedback spring 81 is disposed within an appropriate slot or opening in the center land 110 of the spool 106.

The isolation tube 16 is formed from a single piece of metallic material and includes a massive base 112 which is utilized to receive the fasteners 90 and 92 as is shown in FIG. 4.

Figure 5:
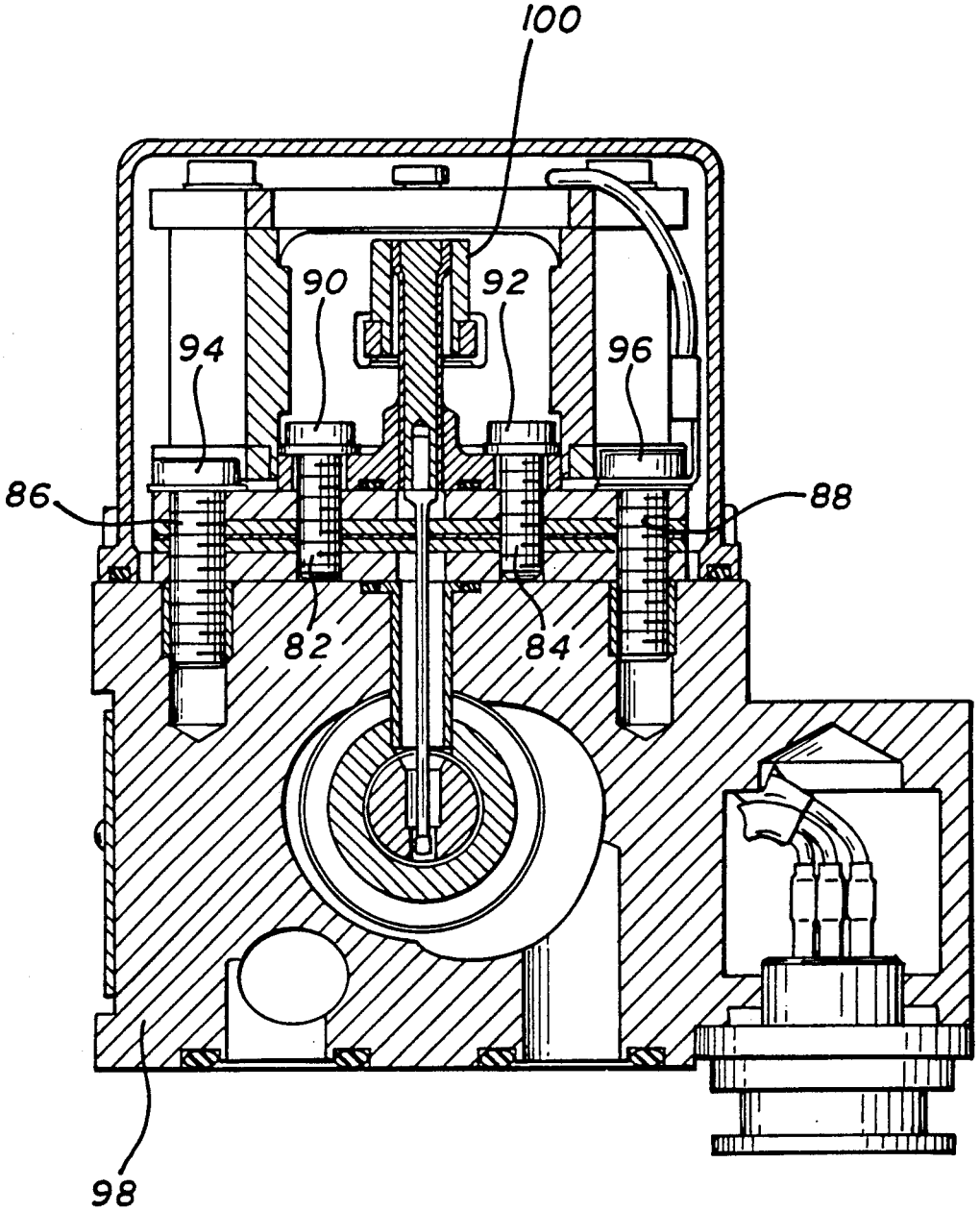
FIG. 5 is a cross-sectional view taken about the lines 5—5 of FIG. 4.

By utilization of the structure of the armature assembly and the integral laminated structure 20 which supports the armature assembly, the fluidic amplifier can be matched to the torque motor so that the first stage hydraulic null and torque motor mechanical and magnetic null are accurately aligned. Such is accomplished by mounting the torque motor sub-assembly upon the integral laminated structure 20 and inserting the fasteners 90 and 92 into the threaded openings 82 and 84 and hand tightening the same. Fluid is then applied to the fluidic amplifier and the torque motor sub-assembly is moved slightly within the tolerances allowed by the fasteners 90 and 92 and the openings through which they pass in the base 112 until hydraulic, mechanic and magnetic null has been achieved. The fasteners are then secured firmly in place to secure the torque motor on the integral laminated assembly 20. This assembly of the first stage may then be utilized with a second stage providing good null stability. When this first stage is installed on the second stage as shown in FIGS. 4 and 5, the first stage can be similarly adjusted to align it with the second stage hydraulic null thereby providing a complete first and second stage servovalve which has excellent null stability.

The flow through the fluidic amplifier may be established at any desired volume according to any particular application at the time the valve is constructed. The volume of fluid flowing from the ejector 52 is determined by the formula:

$$Q = .2597\, C_d A \frac{\sqrt{2}\,\Delta P}{\rho}$$

where:

(Q) is gallons per minute (gpm)

($C_d$) coefficient of discharge (A) area of jet ($\Delta P$) differential pressure across the jet (psig)

($\rho$) fluid density (lbf-sec$^2$/in$^4$)

As can be seen, if the area A of the jet is enlarged, the flow will be enlarged proportionately. In turn, the area of the jet is determined by the area of the ejector nozzle 52. This in turn can be increased by increasing the thickness of the central lamina 22 (FIG. 1). Therefore, by merely increasing the thickness of the lamina 22, the height of the ejector 52 is increased by a like amount while still maintaining the proper characteristics of the ejector nozzle to provide a desired free jet stream. This may be accomplished by providing a thicker, single, central lamina 22 or alternatively, as is shown in FIG. 3, a plurality of thinner laminae 118 through 122 may be provided, each with the through opening as shown at 32 (FIG. 2) and after appropriate alignment, diffusion bonded together to form the fluidic amplifier as shown in FIG. 2. In this manner, by stacking thinner lamina, a fine control can be obtained on flow volume through the first stage valve. As a result, one may obtain very high flow recovery at elevated pressures of greater than 60%.

What is claimed is:

1. A deflector jet servovalve comprising:

a housing;

first means defining a fixed ejector and pair of receivers disposed opposed said ejector arranged to discharge a jet stream of fluid from said ejector to impinge said receivers mounted upon and affixed to said housing;

conduit means defined by said first means for supplying fluid under pressure to said ejector and for receiving any differential fluid output from said receivers;

said first means including a plurality of laminae stacked one upon the other and bonded together to form an integral laminated structure;

a movable deflector means disposed between said ejector and said receivers for deflecting said jet stream relative to said receivers; and electrically activated motor means mounted upon and secured to said first means and coupled to said deflector means for moving said deflector means responsive to electrical signals applied to said motor means.

2. A deflector jet servovalve as defined in claim 1 wherein said motor means is mounted upon said first means by threaded fasteners received within said first means.

3. A deflector jet servovalve as defined in claim 1 wherein said motor means includes an isolation tube having a base member and said threaded fasteners pass through openings defined by said base member.

4. A deflector jet servovalve as defined in claim 1 wherein said first means includes a center lamina, an intermediate lamina bonded to each surface of said center lamina, and an outer lamina bonded to the outer surface of each of said intermediate lamina.

5. A deflector jet servovalve as defined in claim 4 wherein said conduit means is defined by through openings defined in only one of said intermediate laminae.

6. A deflector jet servovalve as defined in claim 5 wherein said center lamina defines a through opening defining said ejector and said receivers.

7. A deflector jet servovalve as defined in claim 6 wherein said one intermediate lamina defines first, second and third through openings, said first opening being aligned with said ejector and said second and third openings being aligned with one of said pair of receivers respectively and said outer lamina bonded to said one intermediate lamina covers said first, second and third through openings to define said conduits.

* * * * *